US006474567B2

(12) United States Patent
Grimmel et al.

(10) Patent No.: US 6,474,567 B2
(45) Date of Patent: Nov. 5, 2002

(54) WATER COOLING DEVICE FOR WIRE

(75) Inventors: Rüdiger Grimmel, Netphen; Karl Keller, Hilchenbach; Klaus Küppers; Meinert Meyer, both of Erkrath; Uwe Plociennik, Ratingen, all of (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/733,007

(22) Filed: Dec. 8, 2000

(65) Prior Publication Data

US 2001/0018174 A1 Aug. 30, 2001

(30) Foreign Application Priority Data

Dec. 16, 1999 (DE) ..... 199 60 638

(51) Int. Cl.[7] ..... B05B 15/00
(52) U.S. Cl. ..... 239/132.3; 239/551
(58) Field of Search ..... 239/132.1, 132.3, 239/132.5, 128, 581.1, 581.2, 551; 72/201

(56) References Cited

U.S. PATENT DOCUMENTS 4,807,457 A * 2/1989 Polino et al. ..... 72/128
5,907,967 A * 6/1999 Kleinefeldt et al. ..... 72/201

FOREIGN PATENT DOCUMENTS

DE 4200272 7/1993
EP 0317785 5/1989

* cited by examiner

*Primary Examiner*—Lisa A. Douglas
(74) *Attorney, Agent, or Firm*—Friedrich Kueffner

(57) ABSTRACT

A water cooling device for a controlled cooling of wire, small sections, and ribbed concrete wire guided along a wire rod guiding line out of the rolling heat has a support frame that is parallel-slidable or rotatable. Parallel, adjacently arranged cooling water pipelines are provided each having a different inner diameter and mounted on the support frame. Each cooling water pipeline has arranged thereat water boxes. The cooling water pipelines have cooling water pipes having an inner pipe diameter matching the inner diameter of the correlated cooling water pipeline. The cooling water pipes are arranged in the water boxes. Each cooling water pipeline has guide grooves positioned between the water boxes for connecting the cooling water pipes of each cooling water pipeline with one another. The cooling water pipelines are configured such that, by parallel-sliding or rotation of the support frame in a direction perpendicular to the wire rod guiding line, each cooling water pipeline is positionable in the wire rod guiding line so that the wire rod is guidable in all of the cooling wire pipes.

7 Claims, 3 Drawing Sheets

WATER COOLING DEVICE FOR WIRE

BACKGROUND OF THE INVENTION

1. Field of the Invention

The invention relates to a water cooling stretch for a controlled cooling of wire, small sections, and ribbed concrete wire coming out of the rolling heat. The water cooling stretch is comprised of water boxes containing cooling water pipes and guide grooves arranged between the water boxes.

2. Description of the Related Art

When rolling wire with subsequent air quenching, it is technologically conventional to pre-cool the wire by means of a water cooling stretch. After exiting from the last rolling stand of the finishing block, the hot rolled wire passes through a water cooling stretch comprised of several water boxes wherein in each one of the water boxes several successively arranged cooling water pipes are provided.

Since the wire rod at the conventionally high rolling speeds of up to >120 m per second must be guided tightly and precisely, the inner diameters of the cooling water pipes and of the guide grooves are matched substantially to the wire diameter. Since, however, increasingly larger diameter ranges must be produced in a manufacturing line, for example, from <5 to >25 mm, this wire diameter range can no longer be covered by a single cooling pipe diameter. For example, for the diameter range of 5 to 25 mm at least three different cooling pipe diameters are required in order to be able to perform an optimal and defined water cooling.

When changing the wire diameter, it is thus required to change also the cooling water pipes and the guide grooves so that considerable downtimes result and, moreover, when a manual modification is carried out, errors such as incorrect selection of the cooling water pipes and imprecise alignment can occur.

In order to avoid such a complex modification process, European patent document EP 0 317 785 B1 proposes a quick-change cooling stretch which is comprised of several parallel portions for a certain wire diameter range, respectively, wherein each section is provided with several cooling units, units for cleaning with water and, optionally, drying units. By rotation about, for example, 180 degrees about a common axis of rotation, the sections with a suitable diameter range can be aligned with the advancing axis of the wire rod.

In addition to the high expenditure of arranging each section by means of a pivot device on an axis of rotation, the expenditure in regard to ensuring the required water connection to the individual cooling units for a rotation of, for example, 180 degrees, is also significant.

In German patent document DE 42 00 272 A1 a device for controlled cooling of the wire rod is proposed for improving the adaptation to different wire rod diameters, wherein the device comprises a series of water boxes with fixedly installed cooling water pipes. Each cooling pipe is provided with different guide elements for the different wire rod diameters. The guide elements are arranged at the ends of the stationary cooling water pipes so as to be exchangeable by means of a sliding device.

For a change of diameter of the wire rod the guide elements are thus simply exchanged. Even though with this device a simple adaptation to different wire rod diameters is possible, the actual cooling action for the different wire rod diameters, however, is performed always in the same cooling water pipes. For large deviations between the wire rod diameter and the inner diameter of the cooling water pipes, the desired optimal and defined water cooling action is no longer ensured.

SUMMARY OF THE INVENTION

It is an object of the present invention to provide a water cooling stretch which can be adapted in a simple way by exchanging the cooling water pipes to different wire rod diameters without causing, by exchanging cooling water pipes and guide elements or guide grooves, lengthy downtimes or additional costs as a result of an erroneous exchange.

In accordance with the present invention, this is achieved in that the entire water cooling stretch is mounted on a support frame which is parallel-slidable or rotatable, wherein the water cooling stretch is comprised of several, preferably three, parallel and adjacently arranged cooling pipelines of different inner diameters, comprising cooling water pipes arranged within water boxes and guide grooves connecting the cooling water pipes external to the water boxes, wherein the cooling pipelines are arranged adjacently to one another such that by parallel movement or pivoting of the support frame perpendicularly to the wire rod guiding line any desired cooling pipeline, comprised of cooling water pipes and guide grooves, can be moved into the wire rod guiding line so that the wire rod can thus be introduced into all of the cooling water pipes.

With the measure according to the invention of arranging the required cooling pipelines for the different wire rod diameters, comprised of correspondingly sized cooling water pipes and guide grooves connected with one another, parallel and adjacently to one another on a slidable common support frame, the required change of the cooling pipelines can be performed in a simple way by displacement of the support frame. The otherwise required modification work and alignment labor, required otherwise for each individual segment of the water cooling stretch, are eliminated. Also, the risk of manual modification errors can be reduced.

According to an advantageous embodiment of the invention the cooling water supply to the cooling water pipes within the water boxes is realized for several cooling water pipes by means of a common nozzle head with parallel and adjacently arranged nozzles with different nozzle openings, wherein for each inner diameter of a cooling pipe a correspondingly sized nozzle is provided. Accordingly, a fixed installation of the water supply is provided which must not be modified even for the parallel movement of the entire water cooling stretch. Only the water supply to the individual nozzles must be controlled which, according to a further advantageous embodiment of the invention, is preferably carried out by means of a rotary slide.

As an alternative, the loading of the individual nozzles can also be realized by means of other control devices, for example, in the form of adjusting flaps, slide valves or also individual valves.

According to a further advantageous design of the invention, the movement of the entire water cooling stretch as well as the control of the water supply to the cooling water pipes selected by the sliding action, respectively, can be remote-controlled. This provides an optimal control and adaptation to the operational sequence.

In order to be able to perform a faster scrap metal removal when disturbances occur, the guide grooves and/or the cooling water pipes are advantageously designed to fold open so that in the case of a disturbance the scrap metal can be removed in a simple way without other modification work.

DESCRIPTION OF THE PREFERRED EMBODIMENTS

Figure 1:
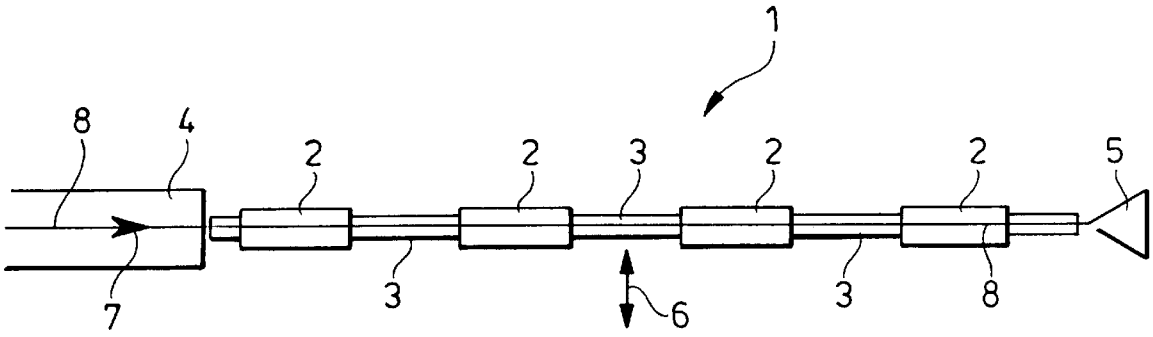
FIG. 1 is a schematic plan view onto a water cooling stretch according to the invention.

FIG. 1 shows in a plan view a water cooling stretch 1 which is arranged between the finishing block 4, from which the wire rod 8 exits into the wire rod guiding line 7, and the laying head 5. The water cooling stretch 1 is comprised of cooling water pipes (cooling water pipes P are illustrated schematically in FIG. 3) arranged in water boxes 2 and guide grooves 3 arranged between the water boxes 2. The guide grooves 3 provide a connection between the cooling water pipes P external to the water boxes 2 and together the cooling water pipes P and the guide grooves form parallel cooling water pipelines PL. The cooling water supply lines to the cooling water pipes in the water boxes 2 are not illustrated in FIG. 1. Moreover, FIG. 1 also does not show that within the water boxes 2 several cooling water pipes with different inner diameters are arranged parallel and adjacent to one another (analog to FIG. 2). Also, the parallel, adjacently arranged guide grooves 3 are not individually illustrated but illustrated schematically in their entirety.

The water cooling stretch 1, which is formed of several cooling pipelines PL for different wire rod diameter ranges, is arranged, inclusive of the water boxes 2 and the cooling water supply lines (not illustrated) extending to the nozzle heads 10 (FIG. 2) of the individual cooling water pipes, on a support frame SF which is configured to be slidable or rotatable in a direction of arrow 6 perpendicularly to the wire rod guiding line 7 by a remote control. When a change of the cooling pipelines PL is required, only a simple parallel movement of the support frame SF is required in order to guide the cooling pipeline PL with the required inner diameter into the wire rod guiding line 7 and to guide the wire rod 8 into the correspondingly sized cooling water pipes P in the water boxes 2 and the guide grooves 3. The guide grooves 3 are foldable (pivot point PP) in the direction of arrow F.

Figure 2:
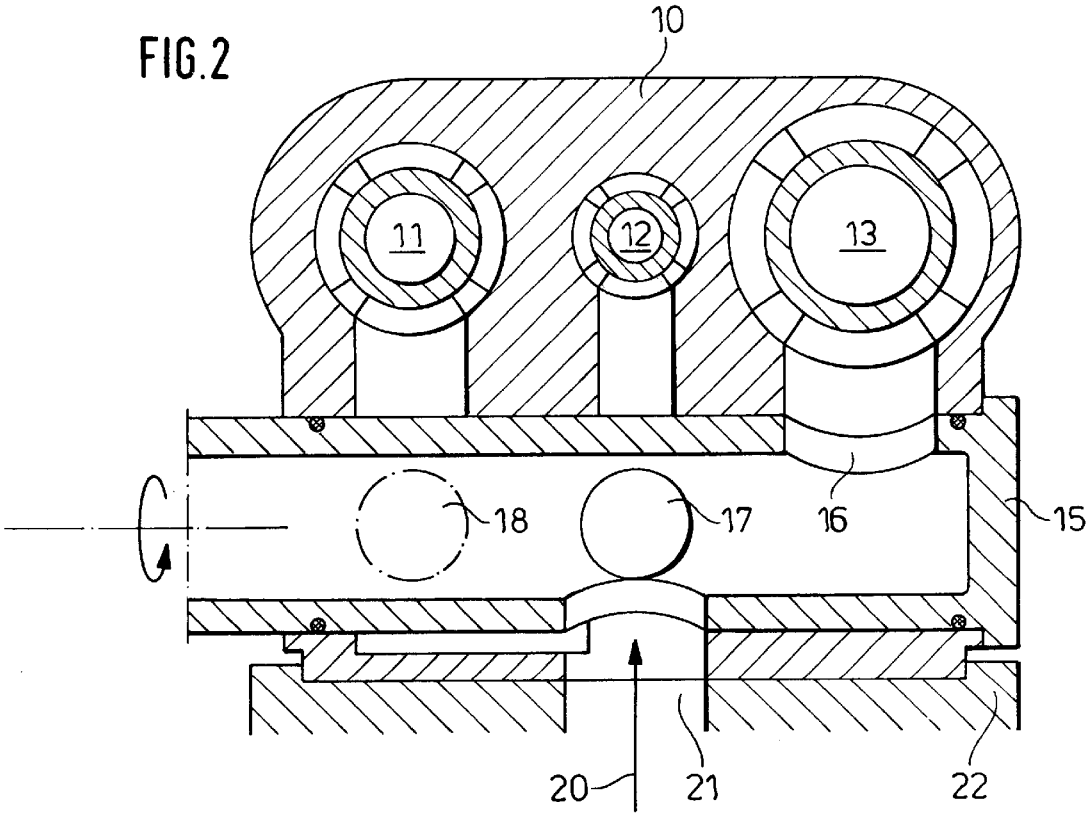
FIG. 2 is a vertical section view of a nozzle head according to the invention.
Figure 3:
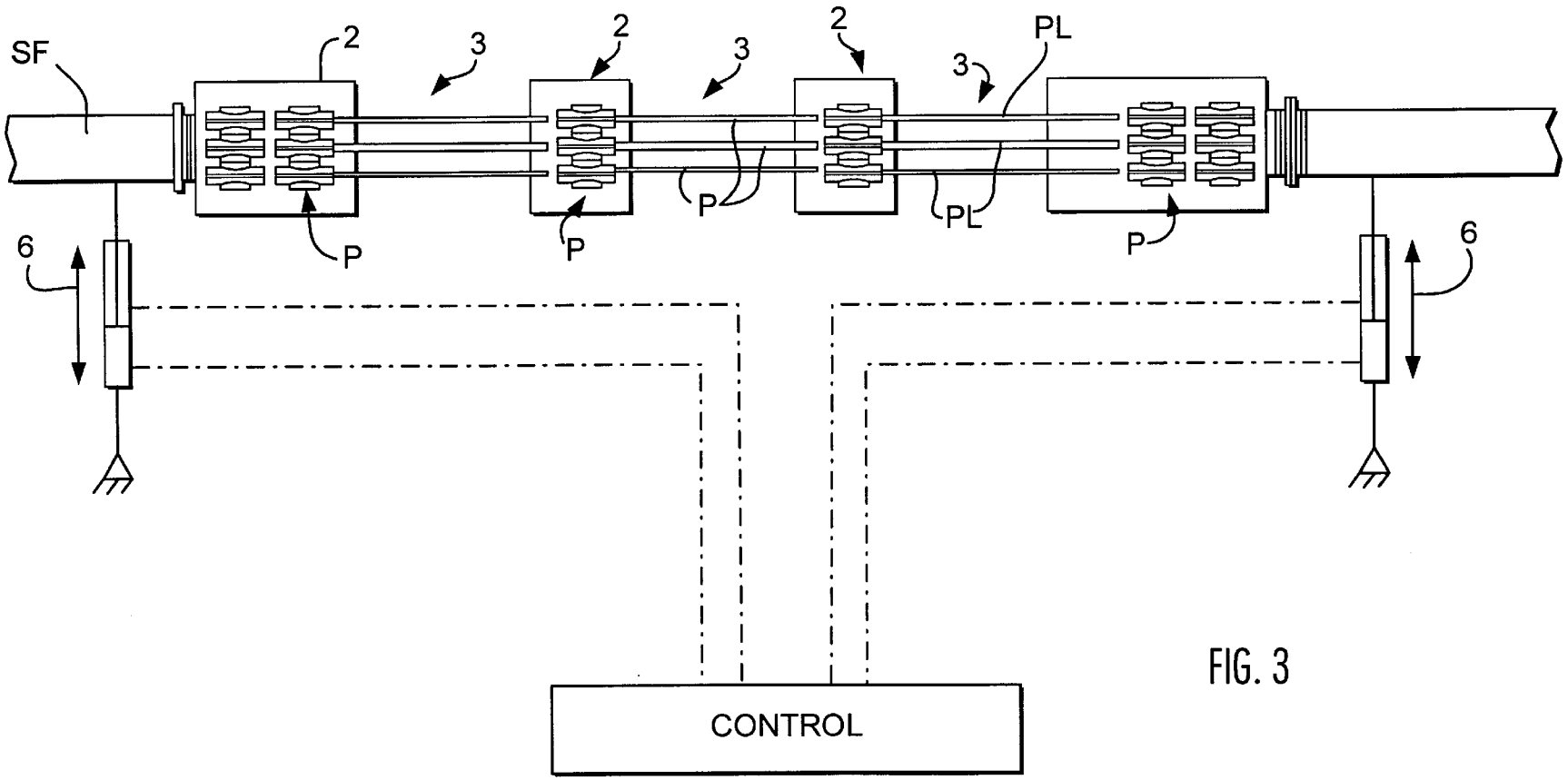
FIG. 3 shows a detail view of the cooling stretch.
Figure 4:
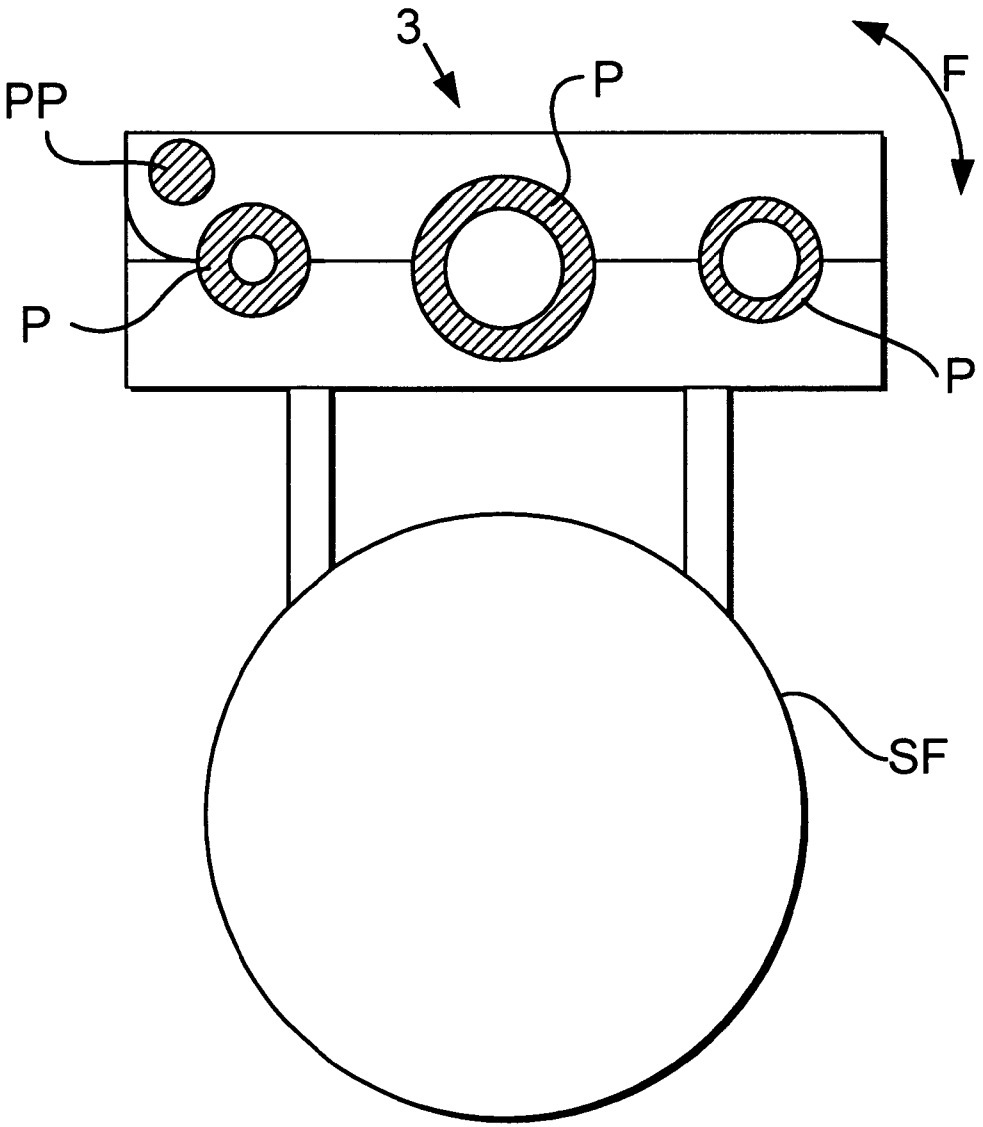
FIG. 4 shows a detail of a foldable guide groove.

In FIG. 2 a vertical section of an exemplary embodiment of a nozzle head 10 for three differently sized nozzles 11, 12, 13 is illustrated. This nozzle head 10 is connected fixedly with its different nozzles 11, 12, 13 to the correspondingly sized cooling water pipes so that the nozzles 11, 12, 13 remain at the correlated cooling water pipes when the entire water cooling stretch 1 is moved.

The cooling water supply to the nozzles 11, 12, 13 is realized by a common rotary slide 15 which, depending on its rotary position, loads one of the nozzles 11, 12, 13 from below with cooling water via the rotary slide openings 16, 17, or 18. The cooling water is guided in the direction of arrow 20 from below via an inlet opening 21 through the foundation 22, supporting the nozzle head 10 and the rotary slide 15, in the upward direction into the rotary slide 15.

The embodiment illustrated in the drawings is only one possible configuration of the invention wherein, of course, the selection of cooling pipelines as well as the number of water boxes. can be adjusted to on-site and process-related conditions.

While specific embodiments of the invention have been shown and described in detail to illustrate the inventive principles, it will be understood that the invention may be embodied otherwise without departing from such principles.

What is claimed is:

1. A water cooling device for a controlled cooling of wire, small sections, and ribbed concrete wire guided along a wire rod guiding line out of a rolling heat, the water cooling device comprising:

a support frame configured to be parallel-slidable;

parallel, adjacently arranged cooling water pipelines forming a water cooling stretch, each one of the cooling water pipelines having a different inner diameter and being mounted on the support frame;

water boxes arranged spaced apart along the cooling water pipelines;

each one of the cooling water pipelines comprised of cooling water pipes having an inner pipe diameter matching the inner diameter of the correlated cooling water pipeline, wherein the cooling water pipes are arranged in the water boxes;

each one of the cooling water pipelines further comprising guide grooves positioned between the water boxes and configured to connect the cooling water pipes of each one of the cooling water pipelines with one another;

wherein the cooling water pipelines are configured such that, by parallel-sliding of the support frame in a direction perpendicular to a wire rod guiding line, each one of the cooling water pipelines is positionable in the wire rod guiding line so that the wire rod is guidable in all of the cooling wire pipes.

2. The water cooling device according to claim 1, wherein three of the water cooling pipelines are arranged adjacent to one another.

3. The water cooling device according to claim 1, wherein each of the water boxes has at least one nozzle head configured to supply cooling water to the cooling water pipes of different pipe diameter and comprising parallel, adjacently arranged differently sized nozzles of different inner nozzle diameters, wherein a number of the nozzles matches a number of the cooling water pipes in the water box and wherein an arrangement of the nozzles with regard to the inner nozzle diameter matches an arrangement of the cooling water pipes with regard to the inner pipe diameter.

4. The water cooling device according to claim 3, wherein each of the water boxes comprises a control device common to all of the differently sized nozzles and configured to control supplying of cooling water to the differently sized nozzles.

5. The water cooling device according to claim 4, wherein the control device is a rotary slide or a slide valve.

6. The water cooling device according to claim 4, wherein the support frame is configured to be remote-controlled for actuating parallel sliding or rotation and wherein the control devices are configured to be remote-controlled.

7. The water cooling device according to claim 1, wherein at least one of the cooling water pipes and the guide grooves is configured to fold open.

* * * * *